US009218950B2

(12) United States Patent
Coughlin et al.

(10) Patent No.: US 9,218,950 B2
(45) Date of Patent: Dec. 22, 2015

(54) CERAMIC DISCHARGE VESSEL AND RELATED LAMP AND METHOD OF MANUFACTURING SUCH A VESSEL

(75) Inventors: Chad Coughlin, Exeter, NH (US); Thomas Wichmann, Berlin (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 13/979,157

(22) PCT Filed: Feb. 10, 2012

(86) PCT No.: PCT/EP2012/052274

§ 371 (c)(1), (2), (4) Date: Jul. 11, 2013

(87) PCT Pub. No.: WO2012/113659

PCT Pub. Date: Aug. 30, 2012

(65) Prior Publication Data

US 2014/0232261 A1 Aug. 21, 2014

Related U.S. Application Data

(60) Provisional application No. 61/445,047, filed on Feb. 22, 2011.

(51) Int. Cl.

| | |
|---|---|
| ***H01J 61/10*** | (2006.01) |
| ***H01J 61/34*** | (2006.01) |
| ***H01J 17/16*** | (2012.01) |
| ***H01J 61/30*** | (2006.01) |
| ***H01J 9/24*** | (2006.01) |

(52) U.S. Cl.

CPC ..... *H01J 61/30* (2013.01); *H01J 9/247* (2013.01); *H01J 61/302* (2013.01)

(58) Field of Classification Search

CPC ..... H01J 61/30; H01J 9/247; H01J 61/302
USPC ..... 313/634, 623
See application file for complete search history.

(56) References Cited

U.S. PATENT DOCUMENTS

| | | | | |
|---|---|---|---|---|
| 5,783,907 | A * | 7/1998 | Suzuki et al. | 313/625 |
| 6,094,008 | A * | 7/2000 | Omori et al. | 313/634 |
| 6,815,893 | B2 * | 11/2004 | Kakisaka et al. | 313/634 |
| 6,819,048 | B2 | 11/2004 | Stockwald | |
| 7,157,867 | B2 | 1/2007 | Stockwald | |
| 7,701,141 | B2 | 4/2010 | Stockwald et al. | |
| 2004/0056599 | A1 | 3/2004 | Brock | |
| 2004/0256994 | A1 * | 12/2004 | Venkataramani et al. | 313/634 |
| 2008/0047665 | A1 * | 2/2008 | Neil et al. | 156/296 |
| 2011/0133663 | A1 | 6/2011 | Stockwald | |

FOREIGN PATENT DOCUMENTS

| | | | |
|---|---|---|---|
| EP | 0991108 | A2 | 4/2000 |
| EP | 1006552 | A1 | 6/2000 |
| EP | 1089321 | A1 | 4/2001 |
| EP | 1202323 | A2 | 5/2002 |
| EP | 1709667 | B1 | 1/2010 |
| WO | 2010018048 | A1 | 2/2010 |

* cited by examiner

*Primary Examiner* — Joseph L Williams

(57) ABSTRACT

A ceramic discharge vessel for discharge lamps is provided, with a central main part which extends between the tips of two electrodes and which is essentially tubular and with two ends for fixing and sealing an electrode system, wherein the ceramic discharge vessel has a longitudinal axis and wherein the main part consists of two halves which are connected in the middle of the main part wherein the two halves are frustoconically shaped with a draft angle p of $0.5° \leq p \leq 7.0°$.

12 Claims, 3 Drawing Sheets

CERAMIC DISCHARGE VESSEL AND RELATED LAMP AND METHOD OF MANUFACTURING SUCH A VESSEL

RELATED APPLICATIONS

The present application is a national stage entry according to 35 U.S.C. §371 of PCT application No.: PCT/EP2012/052274 filed on Feb. 10, 2012, which claims priority from U.S. provisional application No. 61/445,047 filed on Feb. 22, 2011.

TECHNICAL AREA

Various embodiments relate to a ceramic discharge vessel. The vessel is intended for use in high pressure discharge lamps, especially with metal halide fill.

Various embodiments further relate to a related lamp and to a method of manufacture of such a vessel.

BACKGROUND

EP 1 709 667 discloses a metal halide lamp which is made of translucent ceramic. It is surrounded by an outer tube. The vessel has a given length L of a space between the electrodes and a given internal diameter D. The ratio L/D, the so-called aspect ratio, is in the range $4.0 \leq L/D \leq 10.0$.

In other words the vessel has a high aspect ratio L/D. A main part of said vessel extends between two electrodes.

A typical ratio R/r for such lamps is in the range $3.4 \leq R/r \leq 7.0$. The parameter R is an average internal diameter of the portion of the outer tube positionally corresponding to the space between the electrodes, the so-called main part. The parameter r is an external diameter of the main part, within a region positionally corresponding to, in a radial direction of the outer tube and the discharge vessel, the space between the electrodes, on a cross-sectional surface where an outer circumference of the arc tube comes closest to an inner circumference of the outer tube.

WO 2010/018048 discloses a microwave lamp with a vessel whose diameter is reduced towards the ends.

SUMMARY

Various embodiments are provided to ease manufacture and thus to reduce manufacturing costs for a ceramic discharge vessel with high aspect ratio, especially of at least 4.0. Discharge vessels with high aspect ratio are difficult to manufacture. Hitherto they were manufactured as cylindrical tubes.

However, it turned out that a draft angle in the main part of the vessel is beneficial in terms of manufacturability of ceramic green parts. The vessel is often made of typical ceramics like alumina, preferably PCA, or AlON or sapphire or Dy2O3.

A two part design for the main part of the vessel is used which design is already known as a basic principle, see for example US 2004/056599. Such a two part design was used hitherto for bulgy shapes. Another two part solution is disclosed in EP 1 006 552 and EP 991 108 where a vessel shaped as a truncated cone is used together with a separate plug. Details of manufacture for such vessels can be found there. A similar design is disclosed in EP 1 089 321 using a design of two halves which are cylindrical or bulgy. The connection is by a lap joint taking advantage of a frustoconical or step-like shape of the joint region.

The inventive vessel has a main tubular part which is made of two halves which are connected in the middle of the vessel.

The ends of the tubular parts are rounded off and are connected to capillaries or the like. Two electrodes are sealed in the two capillaries.

The main tubular part is not exactly cylindrical but rather the two halves are inclined like truncated cones which are connected at the base. The angle of inclination is called draft angle p.

The draft angle p is chosen in the range $0.5° \leq p \leq 7.0°$. If $p < 0.5°$ there is no advantage concerning manufacturability of the ceramic green part. If $p > 7.0°$ there is an increasing risk that the fill may condense in the middle of the vessel around the ring of connection of the two halves. The specific advantage of the draft angle being between 0.5° and 7.0° is a reduced shrinkage of the vessel after the form shaping process, which can be done for example by injection molding. Another advantage is the reduction of the mold tool wear during the part removal from the mold. Still another advantage is the reduction of drag marks and scratches on the side walls of the two halves. Still another advantage is that the halves can be easily removed from the mold because the ejection forces are reduced.

Essential features of various embodiments are summarized as follows:

Ceramic discharge vessel for discharge lamps, with a central main part which is essentially tubular and with two ends for fixing and sealing an electrode system, wherein the main part consists of two halves which are connected in the middle of the main part wherein the two halves are frustoconically shaped with a draft angle p of $0.5° \leq p \leq 7.0°$.

Preferably the angle p is between 2° and 4°. It is not required that the two angles are identical. They may differ slightly, up to 10% related to the lower value.

The ceramic material of the vessel is preferably made of alumina, preferably doped with zirconia and yttria or other known doping materials.

The aspect ratio of the vessel understood as the arc length between the electrode tips and the maximum inner diameter of the vessel is preferably chosen between 4 and 7.

The halves need not to be fully identical but similar, for example they can be a male and a female part concerning a lap joint or the draft angle of the two parts may differ, preferably up to 10% or even more.

A possible way of manufacturing uses the following steps:

forming two halves from ceramic material in a green state having a frustoconical shape;

joining the two halves at the base line of the truncated cone;

inserting the electrode systems into the ends of the vessel;

applying an outer tube to the vessel.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawings that show, by way of illustration, specific details and embodiments in which the disclosed embodiments may be practiced.

Figure 1:
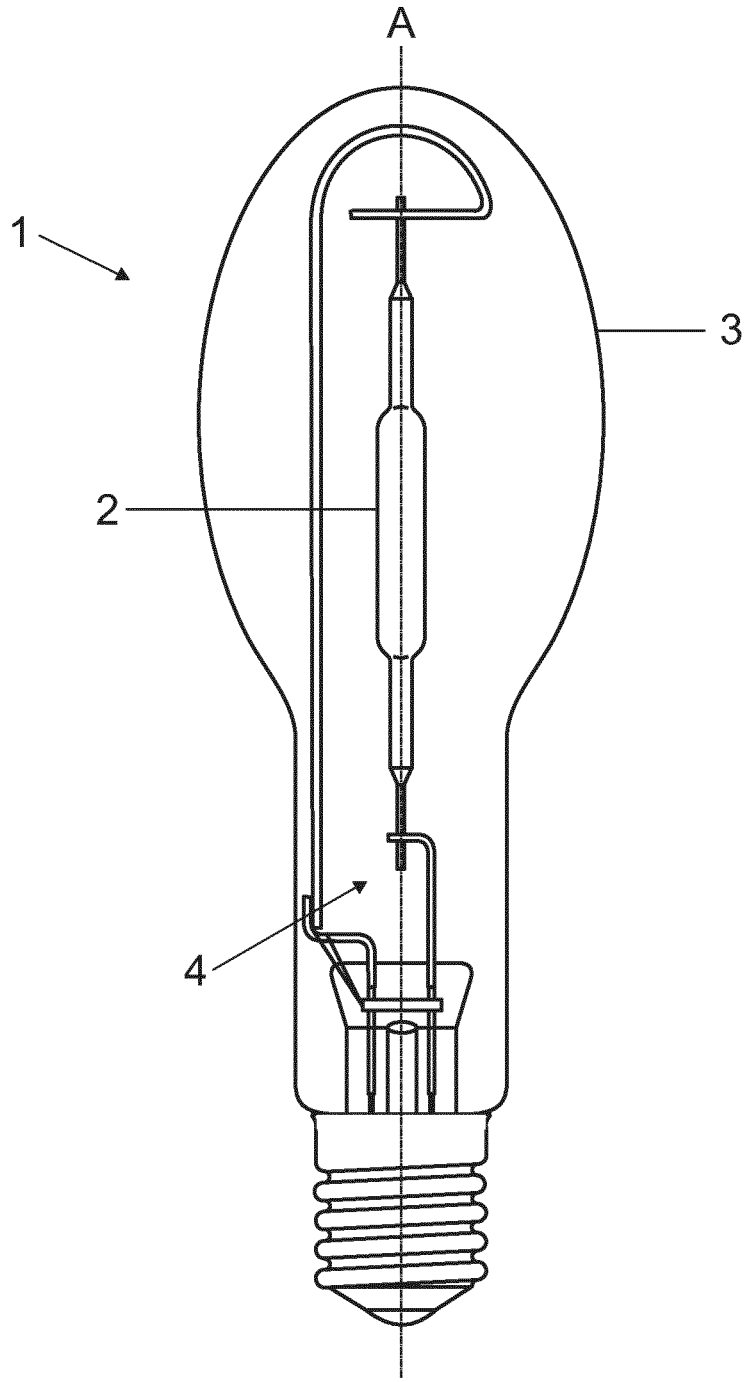
FIG. 1 shows a metal halide lamp with ceramic arc tube.

An embodiment of a metal halide lamp 1 with high aspect ratio is shown in FIG. 1. An essentially cylindrical ceramic discharge vessel 2 is oriented along a longitudinal axis A within an outer bulb 3. A mount 4 within the outer bulb fixes the vessel 2.

The vessel has a high aspect ratio of about 5.0 to 7.0. Such a vessel is intended for street lighting luminaires.

Figure 2:
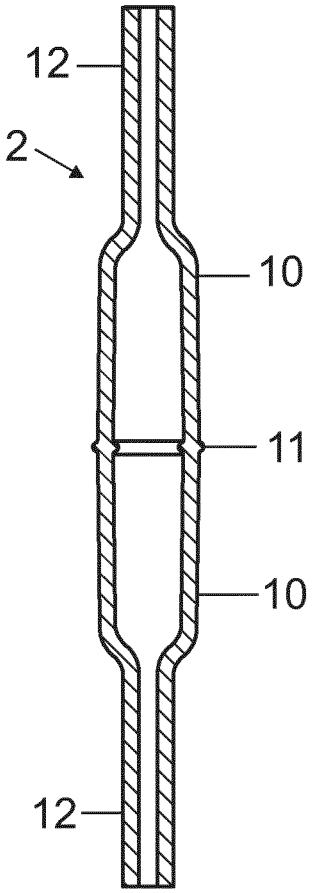
FIG. 2 shows a view to the discharge vessel.

FIG. 2 discloses that the vessel 2 is formed of two halves 10 which are essentially frustoconical shaped with their base line faced towards each other. They are connected in the middle of the vessel by means of a bulge 11. A possible way of connection is to join the halves 10 in their green state. This method includes applying heat to the base line surfaces to be joined to cause a localized melting of the binder material in the green ceramic halves. The surfaces are then brought together and joined by alternately applying compression and stretching. Finally a unitary ceramic arc tube body is formed, see U.S. Pat. No. 6,620,272 for further details. The distal end of each half 10 is rounded off and leads to a capillary 12.

An alternative way of joining is a lap joint as described in EP 1 089 321. Here each half can be produced by conventional ceramic forming technique.

Figure 3:
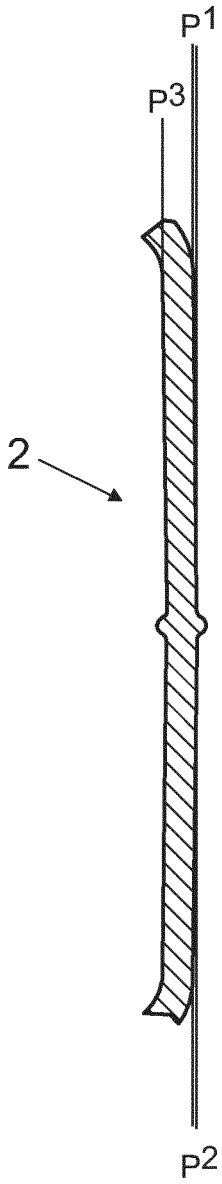
FIG. 3 shows a detailed view of the discharge vessel.

FIG. 3 shows a detail of the vessel 2. The two halves 10 the frustoconically shaped, with a draft angle p1 and p2 of 2° to 4°. For the inside and outside surface of the vessel the same draft angle (p3=p1) is used. The wall thickness of the discharge vessel is constant with the possible exception of the region of the joint, which can be bulgy.

Figure 4:
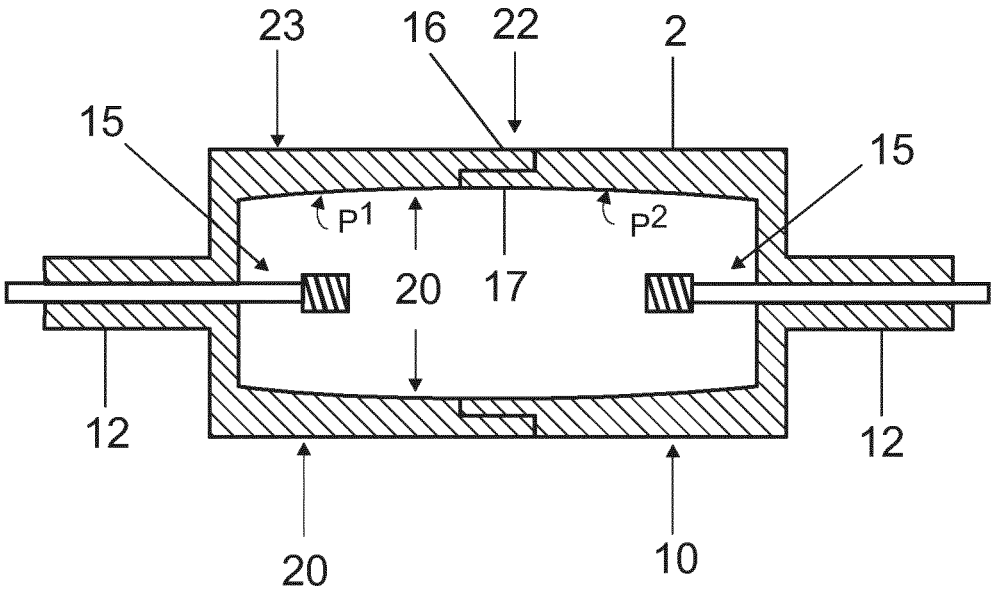
FIG. 4 shows a further embodiment of a discharge vessel.

FIG. 4 shows an embodiment of a vessel 2 using a lap joint. The region 22 of joint has a male and a female section 16, 17 at the two halves which sections fit together. The discharge vessel 2 has two parts 10 and only the inner wall surface 20 of the halves is frustoconically shaped. The outer wall surface 23 is cylindrical. An electrode system 15 is sealed within the capillary 12 by means of solder glass, for example, or direct sintering.

The draft angle p1 and p2 can be different for the two halves 10, as exemplified in this embodiment of FIG. 4. The draft angles are typically chosen as p1=2.1° and p2=2.2°.

As a general rule, the inner and outer draft angle of one half part can vary so that difference in wall thickness could be up preferably at most up to 25%. This corresponds roughly to a difference of at most up to 0.5 degrees.

However it is not excluded to apply higher differences in draft angle for inner and outer draft angle in one half part or for the two halves, especially a value up to 50%.

Concerning the situation of the two halves, the draft angles of the two half parts to be joined may also have the same condition and would make the alignment of the two parts preferably vary by up to 25% wall thickness at most. Again higher values, especially up to 50%, are not excluded.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A ceramic discharge vessel for discharge lamps, with a central main part which extends between the tips of two electrodes and which is essentially tubular and with two ends for fixing and sealing an electrode system, wherein the ceramic discharge vessel has a longitudinal axis and wherein the main part consists of two halves which are connected in the middle of the main part wherein the two halves are frustoconically shaped with a draft angle p of 0.5°≤p≤7.0°, and wherein an inner and outer wall of the discharge vessel is frustoconically shaped at the middle.

2. The ceramic discharge vessel according to claim 1, wherein the angle p is between 2° and 4°.

3. The ceramic discharge vessel according to claim 1, wherein the draft angle of the two halves differs at most up to 10%, related to the lower value.

4. The ceramic discharge vessel according to claim 1, wherein the vessel has a high aspect ratio of at least 4.0.

5. The ceramic discharge vessel according to claim 1, wherein the vessel is essentially made of alumina.

6. The ceramic discharge vessel according to claim 5, wherein the material further contains at least dopants of the kind zirconia and yttria.

7. The ceramic discharge vessel according to claim 1, wherein the draft angle of the two halves differ.

8. A high pressure discharge lamp with a ceramic discharge vessel, with a central main part which extends between the tips of two electrodes and which is essentially tubular and with two ends for fixing and sealing an electrode system, wherein the vessel has a longitudinal axis and wherein the main part consists of two halves which are connected in the middle of the main part wherein the two halves are frustoconically shaped with a draft angle p of 0.5°≤p≤7.0°, and wherein an inner and outer wall of the discharge vessel is frustoconically shaped at the middle.

9. The high pressure discharge lamp according to claim 8, wherein an outer bulb surrounds the ceramic discharge vessel.

10. The high pressure discharge lamp according to claim 8, wherein the ceramic discharge vessel contains two electrodes and a metal halide fill.

11. The high pressure discharge lamp according to claim 8, wherein said lamp is inserted in a luminaire.

12. A method of manufacturing a ceramic discharge vessel, with a central main part which extends between the tips of two electrodes and which is essentially tubular and with two ends for fixing and sealing an electrode system, wherein the vessel has a longitudinal axis and wherein the main part consists of two halves which are connected in the middle of the main part wherein the two halves are frustoconically shaped with a draft angle p of 0.5°≤p≤7.0°, the method comprising: forming two halves from ceramic material in a green state having a frustoconical shape; joining the two halves at the base line of the truncated cone; inserting the electrode systems into the ends of the vessel; and applying an outer tube to the vessel, and wherein an inner and outer wall of the discharge vessel is frustoconically shaped at the middle.

* * * * *